United States Patent [19]

Amici

[11] 4,254,934

[45] Mar. 10, 1981

[54] HYDRAULIC SYPHON WITH PNEUMATIC REFLUX

[76] Inventor: Francesco Amici, Piazza Cavour 17, Rome, Italy

[21] Appl. No.: 62,399

[22] Filed: Jul. 31, 1979

[30] Foreign Application Priority Data

Aug. 4, 1978 [IT] Italy ..... 50597 A/78

[51] Int. Cl.[3] ..... F16K 31/126; E03D 1/04

[52] U.S. Cl. ..... 251/61.1; 4/369; 4/380; 137/138

[58] Field of Search ..... 4/369, 380; 137/138; 251/61.1

[56] References Cited

U.S. PATENT DOCUMENTS 3,973,751 8/1976 Brugnoli et al. ..... 251/61.1

*Primary Examiner*—Gerald A. Michalsky

*Attorney, Agent, or Firm*—Beveridge, DeGrandi, Kline & Lunsford

[57] ABSTRACT

Hydraulic syphon with automatic reflux, working in tanks disposed at whichever height from the discharge point, particularly for the discharge of the tanks for the flushing of water closets.

Two cylindrical tubular elements are disposed, in a position reciprocally inverted with respect to each other, into two other cylindrical tubular elements in such a way as to form annular communicating cavities, which in the syphon's resting position are filled with liquid and gas under pressure. It is thereby obtained an equilibrium between the outer hydrostatic pressure and that inside the syphon.

Bell shaped floating means are solid with one of the cylindrical tubular elements, which are however all solid with each other and, through these, with sealing means made of elastic material, which take care of the closing and respectively opening of the tanks.

A push-button pump having a high inertia introduces gas into the syphon, and recalls it back in the stage of aspiration; by this it breaks the hydrostatic equilibrium and, by causing the sealing means to raise up from their seat, it produces the discharge of the tank.

The floating means serve to keep the sealing means in the lifted position at distance from their seat, together with the entire syphon, for the entire duration of the discharge.

4 Claims, 1 Drawing Figure

HYDRAULIC SYPHON WITH PNEUMATIC REFLUX

Figure 1:
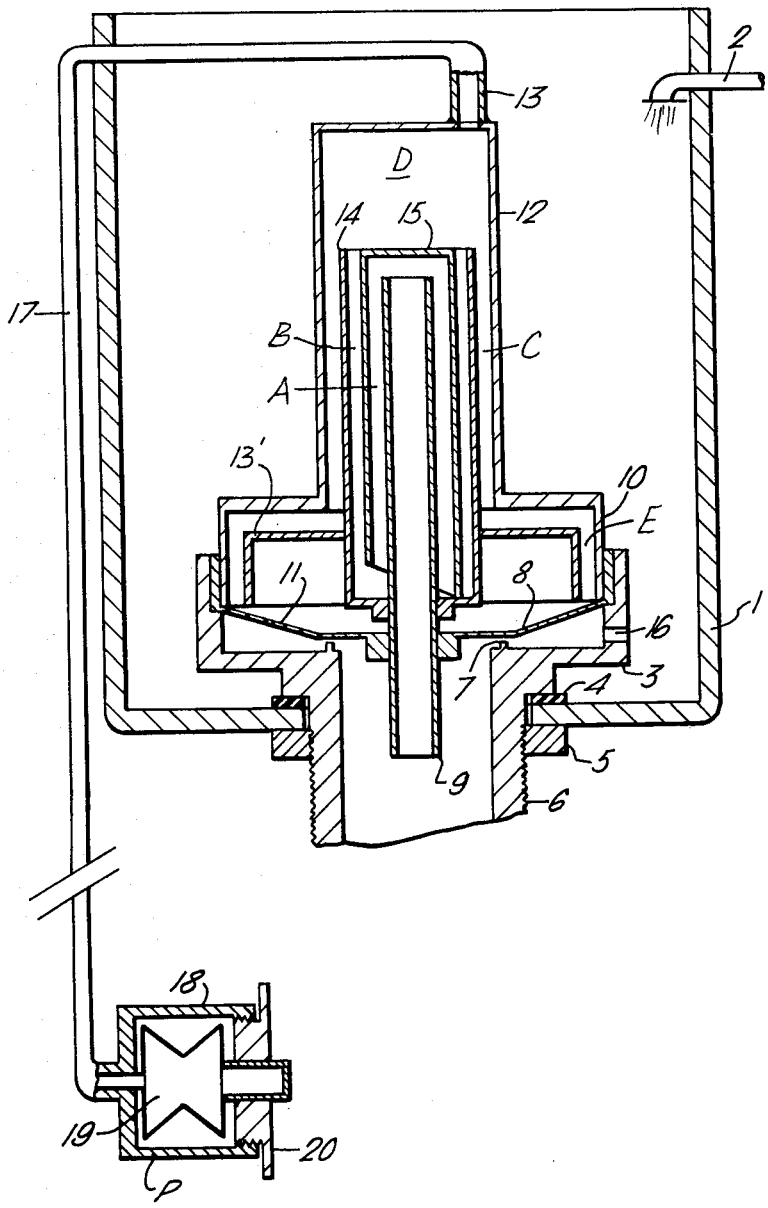

The object of the present invention is a hydraulic syphon with pneumatic reflux, operating in tanks disposed at any height whatsoever from the discharge point, particularly for tanks destined to the flushing of water closets.

Hydraulic syphons with automatic reflux are well known: they are composed essentially by a bell shaped part, whose top is connected with a duct for the discharge of the liquid, with another duct for the introduction and aspiration of a gas (air) and with a priming device which, in the resting position, keeps under pressure a given volume of air after this has been intercepted during the immersion of the syphon, to avoid a self-priming action.

This principle, on which the known reflux-type syphons are based, was developed and improved by the U.S. Pat. No. 3,973,751; this patent confirmed the validity of the former and brought improvements and perfectionments to the existing technique both as regards the realization of the syphon and as regards its operation.

Nevertheless, the syphon realized in accordance with U.S. Pat. No. 3,973,751 presents some inconveniences, first of all that of binding the positioning of the tank to a given level of the discharge point. In fact, should the discharge pipe not possess a sufficient distance (height) from the discharge point, the height of the liquid in this pipe will not be able to determine in the inside of the syphon a depression sufficiently strong to lift up the membrane of the valve and to keep this lifted up from its seat in this position for the entire duration of the discharge of the liquid contained in the tank.

Besides, according with the U.S. Pat. No. 3,973,751, once the priming action is started, the membrane of the valve raises up from its own seat, drawing upwards the innermost tube of the syphon. This will cause a raise of the height of the liquid column comprised between the external wall of a first cylindrical pipe, the innermost one with respect to the syphon, and the inner wall of a second cylindrical pipe of the syphon, having a larger diameter and placed upside-down with respect to the first one and astride of it, the latter cylindrical pipe having its top fixed to the top side of a fourth cylindrical pipe of the syphon which constitutes its external jacket and is bell-shaped. This will cause a remarkable turbulence inside the syphon, which in many cases will interfere with its priming.

Besides, always in U.S. Pat. No. 3,973,751, the push-button pump to initiate the discharge presents an insufficient inertia in the return stage. From this we will obtain a less dependable action on the air contained in the space comprised between the external wall of said second cylindrical pipe of the syphon and the inner wall of a third cylindrical pipe, having a larger diameter than the second tube, and in the space existing over that between the two walls of said two cylindrical tubes, and this precisely between the external wall of the second cylindrical tube and the inner wall of a fourth cylindrical tube of the syphon, the outermost one, with the largest diameter. This reduces the reliability when priming the syphon.

It is therefore one of the purposes of this invention, to supply a hydraulic syphon with automatic reflux, which, by providing improvements and perfectionments as regards the actual state of the art, will be able to operate in an absolutely fool-proof way, at any height whatsoever from the discharge point, and where the reliability of said priming action will be influenced because of the inertia of the push-button pump for the starting of the discharge in its return stage.

The invention fulfills this task by realizing a hydraulic syphon with pneumatic reflux, placed into a discharge tank operating at any height whatsoever from the discharge point, particularly for the discharge of tanks for the flushing of water closets, composed essentially of:

Means for the full sealing, said means being made of any plastic material, provided the latter is waterproof, of a tank, resting on a circular support built around the peripheral area of a pipe for the discharge of the liquid;

a cylindrical-tubular pipe element, with both ends free, onto whose ends said hermetic sealing means will be tightly fitted;

a second tubular element with cylindrical section, closed on the upper end, placed upside down with respect to the first tubular element and astride of the latter, with the upper end closed and slightly distanced from the open end of the named first element, and having the lower end open and cut along a skewed plane;

a third tubular cylindrical element which with its lower end will fit solid with the named first tubular element and with the upper end open being about at the level of the upper closed end of the second named tubular element;

floating means, in the shape of a bell, solid around the third cylindrical tubular element, at a slight distance from said means for tight sealing;

a fourth cylindrical tubular element, whose lower part is expanded to a bell shape, so that it can comprise all the floating means, the latter being also bell shaped, and resting on the tight-sealing means.

The basic concept of this invention is based on the disposition of cylindrical tubular elements in a reciprocally inverted position, so that they form communicating annular cavities, said cavities being filled with liquid and gas under pressure when in the resting position. We obtain thereby an equilibrium between the external and internal hydrostatic pressures in the syphon.

By pressing the push-button of a starting pump, we introduce some gas in the syphon; this gas will alterate the static equilibrium by expelling the gas contained in the same syphon, while the same volume of gas introduced by the push-button pump is recalled back when the pump button is released. The static equilibrium is thereby disturbed, and the discharge of the tank will take place. It goes by itself that the priming action of the pump on the syphon will be the more reliable, the larger will the inertia of the pump be. The invention foresees that the pump works in combination with a bellow unit.

According to the invention, the dependability of the discharge is due also to a floater of the bell type, solid with the third cylindrical tubular element. Besides, all cylindrical tubular elements of the syphon are solid with each other and solid with said means of water-tight lock. The latter are represented by a membrane made of elastic material, occluding the tank's discharge tube.

The result will be that the bell floater will drag, in its upwards displacement, all the parts of the syphon, and will therefore hold the membrane lifted up, thereby assuring the discharge of the liquid.

We will now describe with better detail the object of the invention, with reference to a preferred form of realization which is represented sketchily in the adjoined drawing, where the figures show:

FIG. 1—a vertical section of the hydraulic syphon with pneumatic reflux according to the invention, as applied to a discharge tank; including a cross section of the push-button pump for the starting of the discharge.

In this drawing the FIG. 1 means the liquid tank, 2 indicates the tube through which the liquid is fed, 3 indicates the circular support connected with a watertight junction to tank 1 through the gasket 4 and the threaded nut 5. The latter is screwed on the thread of the discharge tube 6 of tank 1. In the circular support 3 there is in 7 an annular valve provided with a membrane 8 made of elastic material, which fits on the first cylindrical tubular element 9 and on the bell 10 of the fourth cylindrical tubular element 12. The membrane 8 presents, along its peripheral surface, a certain number of gauged perforations 11.

The fourth cylindrical tubular element 12 shows at its end the nipple 13 for the connection of the air pipe leading to the push-button pump (P) for the discharge. Inside the bell 10 there moves the bell-type floater 13', which is solid with the cylindrical tubular element 14, which in turn is solid with the cylindrical tubular element 9. The cylindrical tubular element 15 is disposed between the cylindrical tubular element 14 and the cylindrical tubular element 9; it has its lower end cut askew, with its tip resting on the bottom of the cylindrical tubular element 14, and allows the liquid to flow. The cylindrical tubular element 9 supports the weight of the cylindrical tubular elements 14 and 15 and of the bell-shaped floater 13'; this weight will be applied to the membrane 8, in order to obtain the watertight seal on the seat 7.

Between the tubular cylindrical element 15 and the cylindrical tubular element 9 there is formed the annular cavity A; another annular cavity B is formed between the cylindrical tubular element 14 and 15; an annular cavity C is formed between the cylindrical tubular elements 14 and 12; at the end of the cylindrical tubular element 12 a cavity D is formed, while finally a cavity E is formed inside bell 10.

The circular support shows a certain number of perforations 16 along its side surface. The operation of the hydraulic syphon with pneumatic reflux according to the invention is as follows.

The liquid (water) reaches the tank 1 through tube 2 and, by raising the level, penetrates through the perforations 16, then into the perforations 11, in the annular cavities E and C, overflows from the cylindrical tubular element 14, falls into the annular cavity B to raise then again in the annular cavity A, while the gas remaining in the cavity B and in the chamber D is trapped.

During the further ascent of the liquid in the tank 1, the gas contained in the cavity B and in the chamber D will be compressed and will transfer the pressure to two liquid columns having equal intensity: the external liquid column, comprised between the open border of the cylindrical tubular element 14 and the liquid's level above the same, in the tank 1, and the internal liquid column comprised between the lower border of the cylindrical tubular element 15 and the level which has been reached in that same moment by the liquid in the annular cavity A.

The upmost level in the tank 1 will be reached when the liquid inside the syphon reached the upper border of the cylindrical tubular element 9, when its height in the tank 1 will correspond to that given by the sum of the aforesaid liquid columns. The first one, comprised between the bottom of tank 1 and the upper border of the cylindrical tubular element 14, must therefore be added to the second, which is contained in tank A.

Once the liquid attains its maximum height in tank 1, it will discharge automatically. In fact, by overflowing into the cylindrical tubular element 9, it will draw liquid and gas from the tubular cavities A and B, thus reducing to zero the hydrostatic load in the annular cavity A since, in this moment, the annular cavity is filled with liquid and therefore the pressure of the liquid outside the syphon causes a remarkable speed of circulation in the inside.

The part of the surface of membrane 8 covering the seat 7 is anyhow foreseen smaller than the part of surface of the same membrane which is external to said seat, and runs along the peripheral zone of the annular support 3; the perforations 11 made on the membrane 8 are conveniently gauged. These conditions must be respected to obtain the discharge of the liquid from tank 1 through the seat 7.

The speed of discharge of the liquid through tube 6 and the weight of the liquid, column contained there will draw liquid and create a depression inside the syphon when the free section between the perforations 11 is insufficient. The membrane 8, drawn by the internal depression and impelled upwards to the outside by a hydrostatic load which has become larger that hat existing inside the syphon and acts on a surface larger than the one covering the seat 7, will raise up and open the discharge through the named seat 7.

During the discharge of the liquid, the bell-type floater 13' fills the task of making the internal elements of the syphon to float, by holding the membrane 8 lifted from its seat 7. The syphon, however, can be primed before the maximum level of the liquid in the tank 1 is reached through the immission and recall of compressed gas into the syphon. This is made through a push-button pump (P) for the starting of the discharge, which can be disposed outside the tank and connected to the hose nipple 13 through a tube 17. Said push-button pump (P) is composed preferably of an external casing 18, made of any plastic material, and of a bellow-element 19, also made of plastic, soft material, and of a covering boss 20. When the level of the liquid inside the tank 1 reaches the vicinity of the upper border of the cylindrical tubular element 9, it has reached also a level superior to that of the open end of the cylindrical tubular element 15, where it penetrated by falling through the cavity B; the action of the compressed gas introduced into the syphon will then cause the opening of the seat 7.

By acting on the push-button of the starting pump, compressed gas will reach the chamber D; this gas will bubble through the liquid contained in the chamber A, and will be released into the cylindrical tubular element 9. When the gas is recalled, during the aspirating phase of the pump, the chamber B is filled up with liquid, while the hydrostatic load in the chamber A reaches zero value.

The higher pressure of the external liquid and the load of the liquid column in the cylindrical tubular element 9 will cause a depression inside the syphon, whereby the membrane 8 is lifted and the discharge of the liquid through the seat 7 is open.

When the liquid's level, in its way down, uncovers the holes 11, the syphon will aspirate gas, which in turn will strike against the bell-shaped floater 13'; the latter will move downwards, resting then on the membrane 8 and sealing tightly the seat 7. The cycle starts anew.

In addition we must observe that the level of the liquid in the tank 1 can be adjusted with a faucet of the floater-type, which intercepts the liquid in the optimal conditions for the priming of the syphon. Said optimal conditions are contained within increasing levels into the chamber A.

The form of realization described above was exposed only as an example. There can be, of course, introduced variations as regards the disposition and the dimensions without deflecting from the spirit of the present invention.

I claim:

1. In a hydraulic syphon for a tank having a bottom, an interior and an exterior, of the type including (a) an annular support means mounted on said tank bottom, having an outlet opening to the exterior of said tank, an inlet opening to said tank interior, and a valve seat annularly disposed about said outlet, (b) a membrane having an opening therein annularly supported by said support means, movable from a first position where a portion of said membrane engages said valve seat to a second position not so engaging said valve seat, (c) a first tubular element having a passage therethrough sealingly mounted on said membrane, said passage communicating with said opening in said membrane, (d) a second tubular element annularly disposed around said first tubular element, having its upper end closed and spaced above said first tubular element, (e) a third tubular element annularly disposed around said second tubular element, having its lower end annularly sealed to said first tubular element, (f) a fourth tubular element annularly disposed about said third tubular element, having a bell-shaped lower end mounted on said support means, and a substantially closed upper end;

(g) actuation means in communication with said upper end of said fourth tubular element;

the improvement wherein (i) the lower end of said second tubular element is connected to said first tubular element, and has a cut therein to allow communication between the interior and exterior of said second tubular element, and (ii) the upper end of said third tubular element extends to substantially the same height as the upper end of said second tubular element.

2. The improvement in hydraulic syphons as claimed in claim 1 further comprising a bell-shaped floating means annularly disposed about said third tubular element.

3. The improvement of claim 2 wherein said membrane has perforations between said portion engageable with said valve seat and its annularly supported portion.

4. The improvement of any one of claims 1, 2 or 3 wherein said actuation means comprises a bellows-type element.

* * * * *